US005905216A

United States Patent [19]

Davis

[11] Patent Number: 5,905,216

[45] Date of Patent: May 18, 1999

[54] TRACK FLAG HOLDER

[76] Inventor: David A. Davis, E9102 Oak Leaf La., Wisconsin Dells, Wis. 53965

[21] Appl. No.: 08/925,080

[22] Filed: Sep. 9, 1997

[51] Int. Cl.[6] ..... G09F 7/18

[52] U.S. Cl. ..... 73/866.3; 116/30; 116/173; 246/1 C; 246/477

[58] Field of Search ..... 73/866.3; 116/30, 116/173; 246/1 C, 477

[56] References Cited

U.S. PATENT DOCUMENTS

| | | |
|---|---|---|
| 269,955 | 1/1883 | Paullin . |
| 418,155 | 12/1889 | Berry . |
| 606,197 | 6/1898 | Dunn . |
| 1,301,914 | 4/1919 | Currie . |
| 1,320,380 | 11/1919 | Currie . |
| 1,371,227 | 3/1921 | Currie . |
| 1,435,807 | 11/1922 | Conley . |
| 1,458,808 | 3/1923 | Conley . |
| 1,722,842 | 7/1929 | Fahnestock . |
| 1,747,278 | 2/1930 | Zawyruchia . |
| 5,038,704 | 8/1991 | Dean et al. . |

FOREIGN PATENT DOCUMENTS

| | | |
|---|---|---|
| 394760 | 2/1908 | France . |
| 248157 | 3/1911 | Germany . |
| 268420 | 5/1913 | Germany . |
| 475030 | 2/1927 | Germany . |

*Primary Examiner*—Richard Chilcot
*Assistant Examiner*—Eric S. McCall
*Attorney, Agent, or Firm*—Richard C. Litman

[57] ABSTRACT

A track flag holder is disclosed for attachment to a railroad track in order to support flags designed to alert train operators. The track flag holder includes an adjustable clamp assembly, a flag assembly, and a flag. The adjustable clamp assembly includes a base member designed for passage beneath the track. A modified clevis and a latch pin are used to secure the adjustable clamp assembly to the track. The flag assembly is coupled to the adjustable clamp assembly and includes an arm to which the flag may be mounted. In preferred embodiments of the invention; a padlock or other appropriated security mechanism may be used to secure the track flag holder and deter vandalism.

8 Claims, 3 Drawing Sheets

TRACK FLAG HOLDER

BACKGROUND OF THE INVENTION

1. Field of the Invention

The present invention relates generally to support devices and more particularly to a support device for retaining a signalling device on a rail.

2. Description of the Related Art

Signalling devices are customarily used to forewarn locomotive operators of various conditions which exist on or in the vicinity of the track. Electronic signalling devices are also commonly installed at predetermined intervals to provide warning to the locomotive operator. However, such devices are costly to install and maintain. Furthermore, such signalling devices cannot warn approaching trains of temporary conditions such as speed restrictions, construction on or near the track, or hazardous track conditions.

It is well known that substantial time and distances are required to stop a locomotive or train. Furthermore, government regulations mandate the use of temporary warning devices along the track in order to inform the operating personnel of eminent unsafe or hazardous conditions. Conventional flagging devices typically include a base portion which either rests on the ground surface or is adapted to be driven into the ground along the track siding. The base is used to support a signalling flag and a flag-bearing staff or staffs. Such flagging devices are frequently installed at remote and unattended sites.

There are several defects inherent to the aforementioned flagging devices. Since railroad personnel must necessarily rely upon such temporary devices, it is of paramount importance that the device remain intact throughout the duration of its intended use. It is sometimes difficult to maintain such devices in the proper flagging position. Environmental conditions such as flooding, wildlife, landslides, etc. can easily dislodge the device. Vandals often reposition the flagging devices from their original positions. Furthermore, passing trains often generate a great deal of wind force as they travel pass flags at high speeds. Finally, they may be difficult to quickly and efficiently drive into the ground because of the surfaces upon which the track is laid.

Various attempts have been made to provide convenient and efficient signalling devices. For example, U.S. Pat. No. 269,955 issued on Jan. 2, 1883 to Paullin discloses a detonating railroad track signal. The device is designed to provide visible and audible signals that can be perceived during the day or night. A cap is provided for explosion when the wheel of the train rolls over a plunger on the track.

U.S. Pat. No. 418,155 issued on Dec. 31, 1889 to Berry discloses a railway signal which includes a signal head secured to a vertical bar. The vertical bar is subsequently driven into the ground to support the signal head.

U.S. Pat. No. 606,197 issued on Jun. 28, 1898 to Dunn discloses a railway signal for use along railway lines. The device includes a horizontal arm having one end bent in the form of a hook capable of engaging the inner flange of a track. An adjustable jaw is provided on the arm for engaging the outer flange of the track. The signal is then detachably secured to the arm.

U.S. Pat. No. 1,301,914 issued on Apr. 29, 1919 to Currie discloses a portable railway signal which includes a tubular rod having an offset near its intermediate section. A rod having and offset end is rotatably attached to the tubular rod. A movable flag is positioned on the offset end of the rod. A second rod terminating in jaws is attached to the tubular rod in order to engage the lower flange of the rail.

U.S. Pat. No. 1,320,380 issued on Nov. 4, 1919 also to Currie discloses a railway signal which includes a supporting member having its base portion passing beneath and secured to one side of a rail. The device also includes flag carrying means associated with the base member.

U.S. Pat. No. 1,371,227 issued on Mar. 15, 1921 also to Currie discloses a track signal which includes a base member having spring engaging members. The spring engaging members include turned ends adapted to engage the opposite ends of an angle plate and secure it to the rail.

U.S. Pat. No. 1,435,807 issued on Nov. 14, 1922 and U.S. Pat. No. 1,458,808 issued on Jun. 12, 1923, both to Conley disclose signal flag supports in the form of a V-shaped yoke structure adapted to be engaged behind the customary fish plate. A mast is erected at the apex end of the yoke for carrying a casing to house the signal flag.

U.S. Pat. No. 1,722,842 issued on Jul. 30, 1929 to Fahnestock discloses a signal flag holder which is resiliently mounted onto the rail. The device is adapted to be secured to the rail head and project upwardly at an angle therefrom so that the signalling member is positioned midway between the rails and in full view of a train crew in switching operations.

U.S. Pat. No. 1,747,278 issued on Feb. 18, 1930 to Zawyruchia discloses an apparatus for holding a series of flags for signals. The apparatus includes a collapsible standard and support having means in the standard for mounting a plurality of flags. Means are also provided for retaining the flags in closed or folded condition.

U.S. Pat. No. 5,038,704 issued on Aug. 13, 1991 to Dean et al. discloses a stowable temporary signalling device for rail systems. The device includes an adjustable and fixed clamping mechanism for clasping onto a rail placed therebetween for applying mechanical bias on the rail. A collapsible arm is provided to mount and support a signalling unit thereupon.

French Patent No. 394,760 published on Feb. 1, 1909, German Patent No. 248,157 published on Jun. 15, 1912, German Patent No. 268,420 published on May 4, 1913, and German Patent No. 475,030 all disclose devices for supporting railroad signs.

None of the above inventions and patents, taken either singularly or in combination, is seen to describe the instant invention as claimed. Thus a track flag holder solving the aforementioned problems is desired.

SUMMARY OF THE INVENTION

Accordingly, it is a principal object of the invention to provide a track flag holder.

It is another object of the invention to provide a track flag holder capable of being adjusted for various sized railroad tracks.

It is a further object of the invention to provide a track flag holder capable of being easily transported and quickly installed.

It is an object of the invention to provide improved elements and arrangements thereof in a track flag holder for the purposes described which is inexpensive, dependable and fully effective in accomplishing its intended purposes.

In accordance with the objects of the invention, a track flag holder is provided for attachment to a railroad track. The track flag holder includes an adjustable clamp assembly, a flag assembly, and a flag. The adjustable clamp assembly includes a base member designed for passage beneath the track. A second catch is secured to the base member for engaging one side of the lower portion of the track. A first removable catch is provided for securing the adjustable clamp assembly to tracks of various sizes. In a preferred embodiment of the invention, a modified clevis and a latch pin are used to secure the adjustable clamp assembly to the track.

The flag assembly is coupled to the adjustable clamp assembly. The flag assembly includes an L-shaped bridge which first projects away from the track, and then perpendicularly upward. An arm is provided to engage the L-shaped bridge and provide an elevated surface to which the flag may be mounted. In preferred embodiments of the invention, the L-shaped bridge and the arm may both be provided with apertures, so that a padlock or other appropriate security mechanism may be used to deter vandalism. Furthermore, a handle may be disposed on the surface of the L-shaped bridge for convenient transportation.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
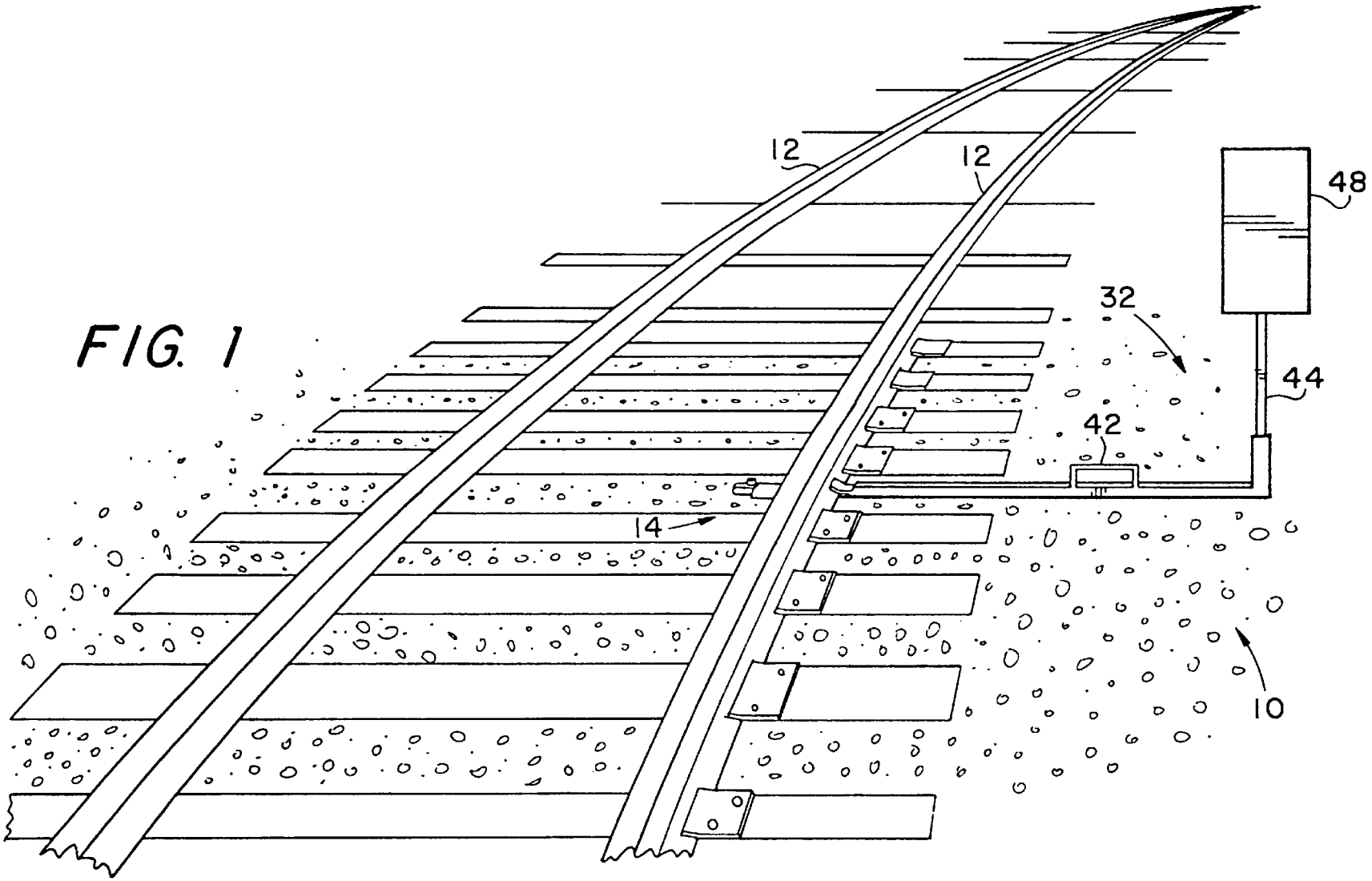
FIG. 1 is a perspective environmental view of a track flag holder according to the present invention.
Figure 2:
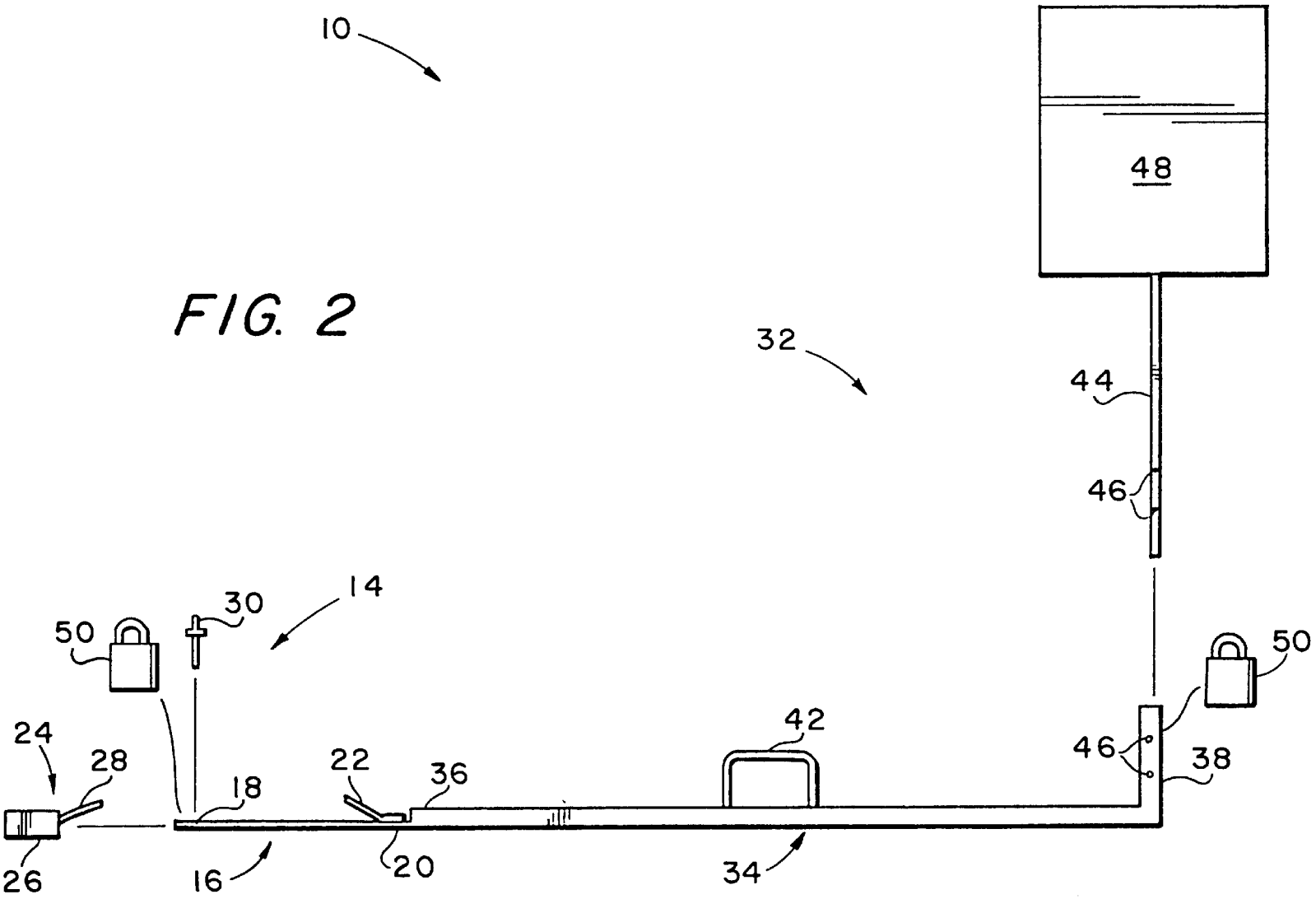
FIG. 2 is an exploded front elevational view of the track flag holder.

With reference to the drawings, and initially to FIGS. 1 and 2 thereof, a track flag holder is shown and generally indicated by the numeral 10. The track flag holder 10 is shown attached to a typical railroad track 12. The track flag holder 10 includes an adjustable clamp assembly 14, a flag assembly 32, and a flag 48. The track flag holder 10 is designed to engage tracks 12 of various sizes quickly and easily.

The adjustable clamp assembly 14 includes a base member 16 which has a generally flat and elongated configuration. The base member 16 includes a first end 18 and a second end 20. A second catch 22 is secured to the base member 16 at a location proximate its first end 18. The second catch 22 is configured such that it is capable of fitting over the lower portion of the track 12 so as to trap the track 12 between itself and the base member 16. Additionally, the base member 16 is designed such that it may be passed beneath the track 12 and its first end 18 extends beyond the track 12. The first end 18 of the base member 16 also contains at least one aperture 46 therethrough.

Figure 3:
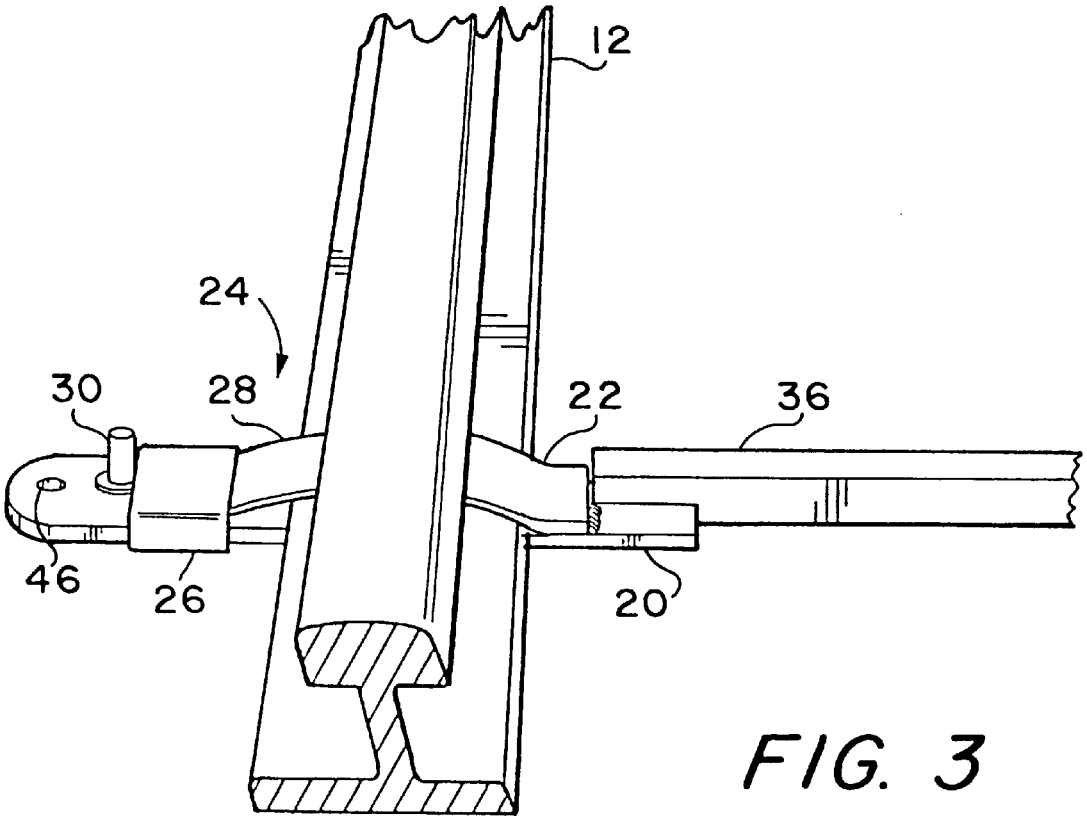
FIG. 3 is a perspective environmental view of the adjustable clamp assembly.
Figure 4:
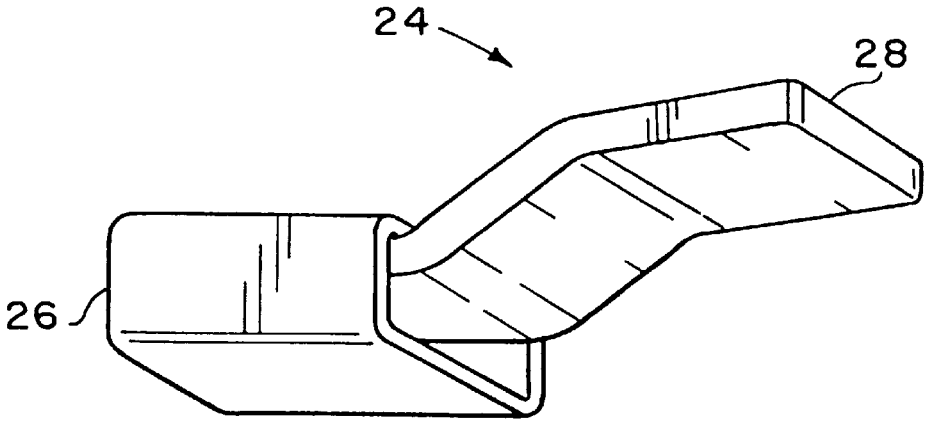
FIG. 4 is a perspective view of the modified clevis.

Referring additionally to FIGS. 3 and 4, the adjustable clamp assembly 14 is secured to the track by means of a clevis 24 and a latch pin 30. The clevis 24 includes a mount 26 which has a generally rectangular cross-section and contains a hollow interior. The mount 26 is designed and configured such that it may receive the first end 18 of the base 16 through its hollow interior. A first catch 28 is secured to the mount 26. The first catch 28 is configured such that it is capable of fitting over the lower portion of the track 12 so as to trap the track 12 between itself and the base member 16. As seen in FIG. 3, the second catch 22 and the first catch 28 engage the track 12 on opposite sides. The apertures 46 on the base member are appropriately positioned to correspond to specific sizes of tracks 12 currently in use. Once the clevis 24 is adjusted over the track 12 the latch pin 30 is inserted through the aperture 46 immediately following the clevis 24 in order to secure the adjustable clamp assembly 14.

The flag assembly 32 includes an L-shaped bridge 34 which has a first end 36 and a second end 38. The first end 36 of the L-shaped bridge 34 which corresponds to the beginning of the flag assembly 32 is coupled to the second end 20 of the base member 16. The second end 38 of the L-shaped bridge 34 extends upward in a manner perpendicular to the ground. The second end 38 of the L-shaped bridge 34 has a hollow interior and contains at least one aperture 46. As seen in FIGS. 1 and 2, a handle 42 may be attached to the L-shaped bridge 34 in order to provide a convenient manner of transporting the track flag holder 10. An arm 44 having a generally elongated shape is configured for insertion into the hollow interior of the second end 38 of the L-shaped bridge 34. The arm 44 also contains at least one aperture 46 which may be placed in registry with the apertures 46 contained in the second end 38 of the L-shaped bridge 34. A flag 48 is attached to the arm 44 in order to provide the necessary visual alert. A roll pin (not shown) can then be inserted into the apertures 46 in order to secure the arm 44 to the L-shaped bridge 34. Alternatively, padlocks 50 or similar locking devices may be used in place of either the roll pin or the latch pin 30 to secure the arm 44 or the adjustable clamp assembly 14, respectively. Such an option can be used in situations where vandals might try to remove the track flag holder 10 in part or in full.

It is to be understood that the present invention is not limited to the embodiment described above, but encompasses any and all embodiments within the scope of the following claims.

I claim:

1. A track flag holder comprising:

adjustable clamp assembly for securing said track flag holder to a track, said adjustable clamp including:

a base member of generally flat and elongated configuration, said base member including a first end and a second end, said first end including a plurality of apertures;

a removable and adjustable first catch at said first end of said base member having a sleeve having a generally rectangular cross-section and containing a hollow interior, said sleeve being appropriately sized for receipt of the first end of said base member and a latch pin for engaging one of said plurality of apertures disposed on said base member, such that said adjustable clamp assembly can be adjusted to fit various sized tracks; and a second catch fixedly secured to said base member proximate said second end, said second catch being oriented and configured for receiving the lower portion of the track between said second catch and said base member; and a flag assembly having a first end coupled to said second end of said base member.

2. A track flag holder as recited in claim 1 wherein said flag assembly includes:

an L-shaped bridge having a second end extending upward, said second end of said L-shaped bridge having a hollow interior and defining at least one aperture; and an arm configured for insertion within the second end of said L-shaped bridge, said arm being further configured for attachment of a flag thereto, and said arm defining at least one aperture, said at least one aperture of said arm being positionable in alignment with said at least one aperture of said L-shaped bridge.

3. A track flag holder as recited in claim 2 further comprising a handle secured to said L-shaped bridge.

4. A track flag holder as recited in claim 2 further comprising first locking means for preventing tamper with said adjustable clamp assembly.

5. A track flag holder as recited in claim 4 wherein said first locking means comprises a padlock for engaging at least one of said plurality of apertures contained in said base.

6. A track flag holder as recited in claim 2 further comprising second locking means for preventing tamper with said flag.

7. A track flag holder as recited in claim 6 wherein said second locking means comprises a padlock for engaging one of the apertures contained in said arm and one of said plurality of apertures contained in the second end of said L-shaped bridge.

8. A track flag holder as recited in claim 1 wherein said sleeve is secured to said first catch such that said mount and said first catch can be brought into slidable engagement with a track.

* * * * *